US009784147B1

(12) United States Patent
Harmon, Sr.

(10) Patent No.: US 9,784,147 B1
(45) Date of Patent: Oct. 10, 2017

(54) FLUID-ELECTRIC ACTUATED RECIPROCATING PISTON ENGINE VALVES

(71) Applicant: Thermal Power Recovery LLC, Mahtomedi, MN (US)

(72) Inventor: James V. Harmon, Sr., Mahtomedi, MN (US)

(73) Assignee: Thermal Power Recovery LLC, Mahtomedi, MN (US)

( * ) Notice: Subject to any disclaimer, the term of this patent is extended or adjusted under 35 U.S.C. 154(b) by 0 days.

(21) Appl. No.: 15/055,138

(22) Filed: Feb. 26, 2016

Related U.S. Application Data

(63) Continuation-in-part of application No. 13/532,853, filed on Jun. 26, 2012, now Pat. No. 9,316,130, which is a continuation-in-part of application No. 12/959,025, filed on Dec. 2, 2010, now Pat. No. 8,448,440, which is a continuation-in-part of application No. 12/844,607, filed on Jul. 27, 2010, now Pat. No. 8,661,817, said application No. 12/959,025 is a continuation-in-part of application No. 12/539,987, filed on Aug. 12, 2009, now Pat. No.
(Continued)

(51) Int. Cl.
*F02B 33/44* (2006.01)
*F01L 9/04* (2006.01)
*F01L 9/02* (2006.01)

(52) U.S. Cl.
CPC ..... *F01L 9/04* (2013.01); *F01L 9/026* (2013.01); *F01L 2009/043* (2013.01); *F01L 2009/0432* (2013.01)

(58) Field of Classification Search
CPC ..... F01L 9/04; F01L 9/026; F01L 2009/043; F01L 2009/0432
USPC ..... 60/614; 123/90.11–90.12, 90.15–90.17
See application file for complete search history.

(56) References Cited

U.S. PATENT DOCUMENTS 885,459 A * 4/1908 Engler et al. ..... F01L 9/02 123/90.12
3,665,898 A 5/1972 Kamazuka
(Continued)

FOREIGN PATENT DOCUMENTS

DE EP 0971099 A1 * 1/2000 ..... F01L 9/04

OTHER PUBLICATIONS

SAE International #2011-01-0940 An efficien lift Control Technique in Electrohydraulic Camless Valvetrail Using Variable speed pump, published Apr. 12, 2011.

*Primary Examiner* — Thai Ba Trieu
(74) *Attorney, Agent, or Firm* — Thomas J. Nikolai; Nikolai & Mersereau, P.A.

(57) ABSTRACT

A mechanically simplified electric and fluid (gas, vapor or liquid) control for a piston engine, including an engine valve actuator system that eliminates rotating cam shafts and heavy internal combustion engine valve closing springs by using an electromagnet and an armature which is attracted by the electromagnet to initiate movement of both a fluid control valve and the engine valve. When the control valve is moved only slightly off its seat by the armature, fluid pressure instantly drives the control valve a much greater distance closing the engine valve. Opening and closing time is regulated independently. Engine valves are opened by reversing the fluid pressure balance across the control valve at the time selected.

18 Claims, 7 Drawing Sheets

Related U.S. Application Data

8,061,140, which is a continuation-in-part of application No. 12/492,773, filed on Jun. 26, 2009, now abandoned, which is a continuation-in-part of application No. 12/387,113, filed on Apr. 28, 2009, now Pat. No. 8,109,097, which is a continuation-in-part of application No. 12/075,042, filed on Mar. 7, 2008, now Pat. No. 7,997,080.

(60) Provisional application No. 61/320,959, filed on Apr. 5, 2010, provisional application No. 61/309,640, filed on Mar. 2, 2010, provisional application No. 60/905,732, filed on Mar. 7, 2007.

(56) References Cited

U.S. PATENT DOCUMENTS 3,698,437 A * 10/1972 Cox ..... F16K 11/07 137/625.62
3,719,322 A * 3/1973 Gifford ..... F16K 17/38 236/102
3,738,337 A * 6/1973 Massie ..... F01L 9/02 123/90.11
3,882,833 A * 5/1975 Longstaff ..... F01L 9/04 123/90.11
4,009,695 A 3/1977 Ule
4,168,655 A 9/1979 Kitrilakis et al.
4,239,153 A * 12/1980 Monigold ..... F16K 17/38 236/35.3
4,464,977 A * 8/1984 Brundage ..... F15B 9/03 137/529
4,596,271 A * 6/1986 Brundage ..... F15B 9/03 137/529
4,611,631 A 9/1986 Kosugi et al.
4,666,087 A 5/1987 Jaggle et al.
4,777,915 A * 10/1988 Bonvallet ..... F01L 9/04 123/90.11
4,794,890 A * 1/1989 Richeson, Jr. ..... F01L 1/16 123/90.11
4,829,947 A 5/1989 Lequesne
4,831,973 A * 5/1989 Richeson, Jr. ..... F01L 9/04 123/90.11
4,878,464 A 11/1989 Richeson, Jr. et al.
4,928,658 A * 5/1990 Ferrenberg ..... F02B 75/02 123/543
4,949,215 A 8/1990 Studtmann et al.
4,974,495 A 12/1990 Richeson, Jr.
5,022,358 A * 6/1991 Richeson ..... F01L 9/02 123/90.11
5,129,619 A * 7/1992 Castetter ..... F16K 31/086 137/487
5,129,620 A * 7/1992 Castetter ..... F16K 31/086 137/486
5,193,495 A * 3/1993 Wood, III ..... F01L 9/026 123/90.12
5,248,123 A 9/1993 Richeson et al.
5,479,890 A 1/1996 Hu et al.
5,509,637 A 4/1996 Leonard
5,570,721 A 11/1996 Funke et al.
5,619,963 A * 4/1997 Faletti ..... F01L 13/06 123/321
5,687,693 A 11/1997 Chen et al.
6,076,490 A * 6/2000 Esch ..... F01L 9/04 123/90.11
6,089,197 A 7/2000 Lange et al.
6,102,004 A 8/2000 Cowden et al.
6,116,570 A * 9/2000 Bulgatz ..... F01L 1/24 123/90.11
6,220,210 B1 4/2001 Kobayashi et al.
6,237,550 B1 5/2001 Hatano et al.
6,340,012 B1 * 1/2002 Yamashita ..... F01M 11/0004 123/195 C
6,359,435 B1 * 3/2002 Czimmek ..... F01L 9/04 123/90.11
6,402,057 B1 6/2002 Kimmel et al.
6,443,111 B1 9/2002 LaDow
6,476,599 B1 * 11/2002 Czimmek ..... F01L 9/04 123/90.11
6,604,497 B2 8/2003 Buehrle, II et al.
6,838,965 B1 * 1/2005 Von Gaisberg ..... F01L 9/04 123/90.11
6,899,313 B2 * 5/2005 Carrillo ..... F16K 31/0665 123/90.12
6,968,813 B2 * 11/2005 Isobe ..... F01L 1/3442 123/90.11
7,063,054 B2 6/2006 Minato et al.
7,347,171 B2 3/2008 Leman et al.
7,458,395 B2 12/2008 Haynes et al.
7,520,488 B2 4/2009 Yoshimura
7,997,080 B2 8/2011 Harmon, Sr. et al.
8,061,140 B2 11/2011 Harmon, Sr.
8,109,097 B2 2/2012 Harmon, Sr. et al.
8,448,440 B2 5/2013 Peoples et al.
8,661,817 B2 3/2014 Harmon, Sr. et al.
9,316,130 B1 4/2016 Harmon, Sr. et al.
2004/0262557 A1 * 12/2004 Carrillo ..... F16K 31/0665 251/129.14
2014/0034135 A1 * 2/2014 Beschorner ..... F16K 31/12 137/489.5

* cited by examiner

ECU
58
19e
10
19b
20
19c
17a
17
19d
72
G
S
A
24a
18a
N
S
B
G
51
18
18b
24
20a
51b
51a
20a
60a
23
R
21a
61
28
21
27
28
30
11
42
21c
21c
R
26
16f
53
60
14d
26a
26
32
11
16a
16
14c
40
16b
54
44
46
40
42
13a
13b
48
56

13
14a
14b
12b
14
12a

FLUID-ELECTRIC ACTUATED RECIPROCATING PISTON ENGINE VALVES

CROSS REFERENCE TO RELATED APPLICATIONS

The present application is a continuation-in-part of Ser. No. 13/532,853, filed Jun. 26, 2012, now U.S. Pat. No. 9,316,130, which is a continuation-in-part of application Ser. No. 12/959,025, filed Dec. 2, 2010, which in turn is a continuation-in-part of application Ser. No. 12/539,987, filed Aug. 12, 2009, which in turn is a continuation-in-part of application Ser. No. 12/492,773, filed Jun. 26, 2009 (now abandoned), a continuation-in-part of copending application Ser. No. 12/844,607, filed Jul. 27, 2010, a continuation-in-part of Ser. No. 12/387,113, filed Apr. 28, 2009 and Ser. No. 12/075,042, filed Mar. 7, 2008.

The applicants also claim the benefit of the following provisional applications: 61/309,640, filed Mar. 2, 2010; and 61/320,959, filed Apr. 5, 2010; and 60/905,732, filed Mar. 7, 2007, all of which are incorporated herein by reference.

FIELD OF THE INVENTION

This invention relates to fluid-electric actuated valves for reciprocating piston engines such as internal combustion (I.C.) engine valves that are opened and closed by means of an electric current in combination with pressure applied by a fluid that may either be vapor such as steam a gas such as compressed air or a liquid such as hydraulic fluid.

BACKGROUND OF THE INVENTION

The electronic operation of reciprocating piston engine valves such as internal combustion engine valves offers the potential of advancing or retarding valve actuation (phase control) as well as the possibility of electronically tailoring the valve opening and closing time within each cycle of operation by means of the engine control unit computer to reach performance goals such as reduced fuel consumption that are unobtainable with variable camshaft phasing currently used for example in cars and trucks.

Several electrical and hydraulic systems have been proposed but none have been commercially successful with regard to cost and performance. Fully electric designs exemplified by U.S. Pat. Nos. 4,829,947; 6,220,210 and 6,237,550 have been proposed but have not been adapted for wide sale commercial use. The same is true of electrohydraulic internal combustion valve actuators such as those described in U.S. Pat. Nos. 5,509,637; 4,009,695; 6,604,497; 4,878,464; 4,974,495; 6,089,197; 7,063,054 or 7,347,171. Steam engine valves have been actuated by an electromagnet and by steam, e.g., U.S. Pat. No. 8,448,440 but steam is not available in cars or trucks and there is no internal combustion (I.C.) valve nor any recognition in the patent of applicability or benefit concerning internal combustion engines.

Existing I.C. valve actuator systems ordinarily require a heavy duty engine valve closing spring for applying a force of typically about 300 lb.-1000 lb. together with one or more solenoid operated hydraulic valves each connected by ducts to a hydraulic actuator piston which is, in turn, connected to the engine intake or exhaust valve. Besides being complicated in construction, the heavy valve seating springs can reduce valve cycling speed and contribute to valve actuator power requirements which are a function of the product of spring stiffness and the square of the valve lift.

In view of these and other deficiencies found in previous reciprocating engines such as internal combustion engine valves and actuators such as those proposed for use in vehicles, e.g., cars and trucks, it is a general object of the present invention to find a mechanically simplified yet more effective way to employ electric control of a fluid (gas such as air or a liquid) for regulating the opening and closing of internal combustion (I.C.) engine valves at different selected time intervals.

Another object is to be able to open and close I.C. valves at a significantly faster rate than is accomplished by the harmonic action of a camshaft.

Another object is to find a way to actuate I.C. valves using electronic triggering that is capable of operating the I.C. valves with variable phase control at a cycling rate of at least 60 Hz (7200 rpm for a four-stroke engine).

Still another object is to provide a fluid actuated I.C. valve in which fluid at supply pressure applies a selected I.C. opening force followed by a closing force great enough to achieve an abrupt closing action.

Still another object is to provide electromagnetic valve actuation with a significant valve lift, e.g., 10 mm or ⅜ inch, yet provide a magnetic traction force to initiate valve motion that is not significantly diminished by being applied in an area of reduced magnetic flux density.

Another object is to provide I.C. engine in which I.C. valve closing motion is initiated electrically and is continued in the same direction by the application of fluid pressure Another object is to begin closure of the I.C. valve electrically and to open the valve by the application of fluid pressure at the end of a separately determined time period.

Another object of the invention is to operate I.C. engine valves using a single signal, e.g., an electrical current sufficient to initiate timed valve closure in which the timed opening step that follows continues automatically without a need to either engage further mechanical elements or provide added electronic input.

Yet another object of the invention is to close each I.C. valve entirely or almost entirely by fluid pressure rather than by using a heavy valve spring of the kind commonly found in I.C. engines thereby eliminating the resistance of a typical valve spring, reducing valve work and achieving higher cycling rates.

These and other more detailed and specific object and advantages of the present invention will be better understood by reference to the following figures and detailed description which illustrate by way of example but a few of the various forms of the invention within the scope of the appended claims All citations listed herein are incorporated herein by reference as fully and completely as if reproduced herein in their entirety and specifically indicated to be incorporated.

SUMMARY OF THE INVENTION

The present invention provides an actuator assembly for reciprocating piston engines such as internal combustion engines in which an electromagnet having an armature and a control valve having a valve piston or spool are all operatively associated with one another on a common valve stem that can transmit opening and closing motion to an internal combustion inlet or exhaust valve and yieldable biases the internal combustion valve to an open position. While having a simple mechanical construction the invention is able to eliminate the heavy closing spring commonly used on such inlet or exhaust valve while also eliminating cam shafts, push rods and rockers. In operation, the electromagnet armature when attracted by the electromagnet initiates movement of both the I.C. engine valve and fluid control valve by moving through a narrow air gap (typically less than 0.025 inch or 0.38 millimeter). After the control valve piston is thus moved slightly off its seat, pressurized fluid, e.g., air or hydraulic fluid is injected between the valve and its seat, instantly driving the spool the much greater distance required to seat the I.C. valve and continue to hold it closed for the rest of its cycle. An electronic control unit (ECU) controls the time the I.C. valve is allowed to remain closed. Fluid pressure is then balanced at both ends of the control valve piston (spool) which may have a different diameter at each end allowing an equal fluid pressure on the ends to drive the control valve spool in a reverse direction to open the I.C. valve. Both opening and closing events are controlled independently by the ECU thereby enabling the beginning, duration and end of the valve-open interval to each be changed separately as required to optimize engine operating conditions. Actuators according to the invention can also be used on other reciprocating piston engines such as steam engines.

DETAILED DESCRIPTION OF THE PREFERRED EMBODIMENTS

Figure 1:
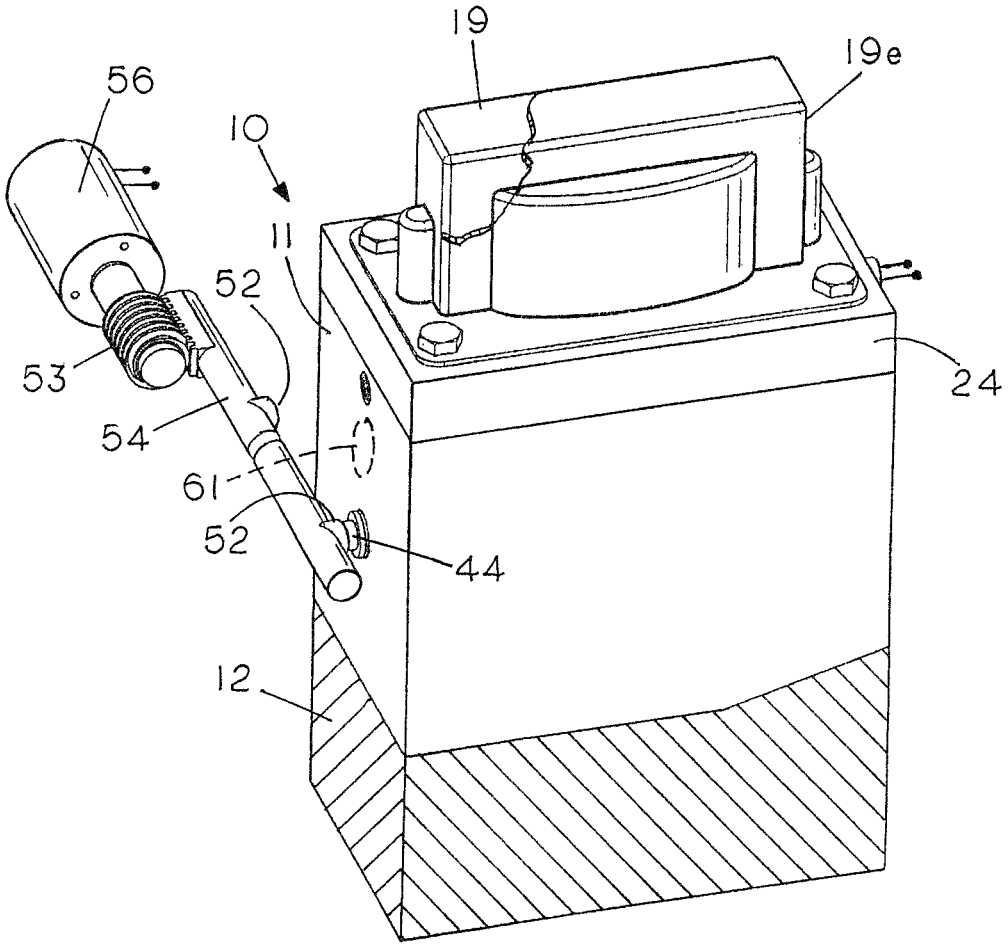
FIG. 1 is a perspective view of the invention installed on an engine.
Figure 3:
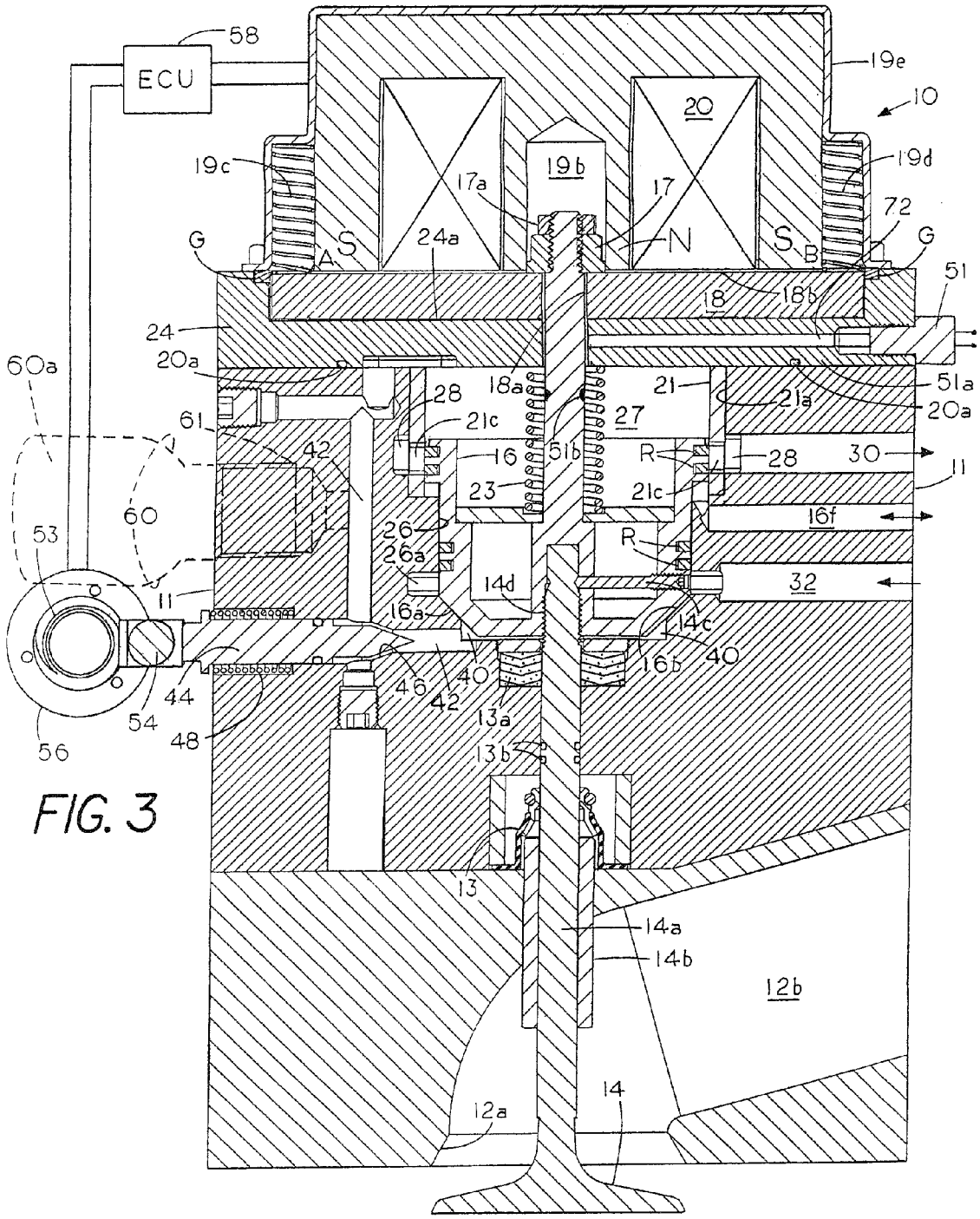
FIG. 3 is a semi-diagrammatic vertical sectional view of the invention taken on line 3-3 of FIG. 2 with the internal combustion (I.C.) valve open.
Figure 4:
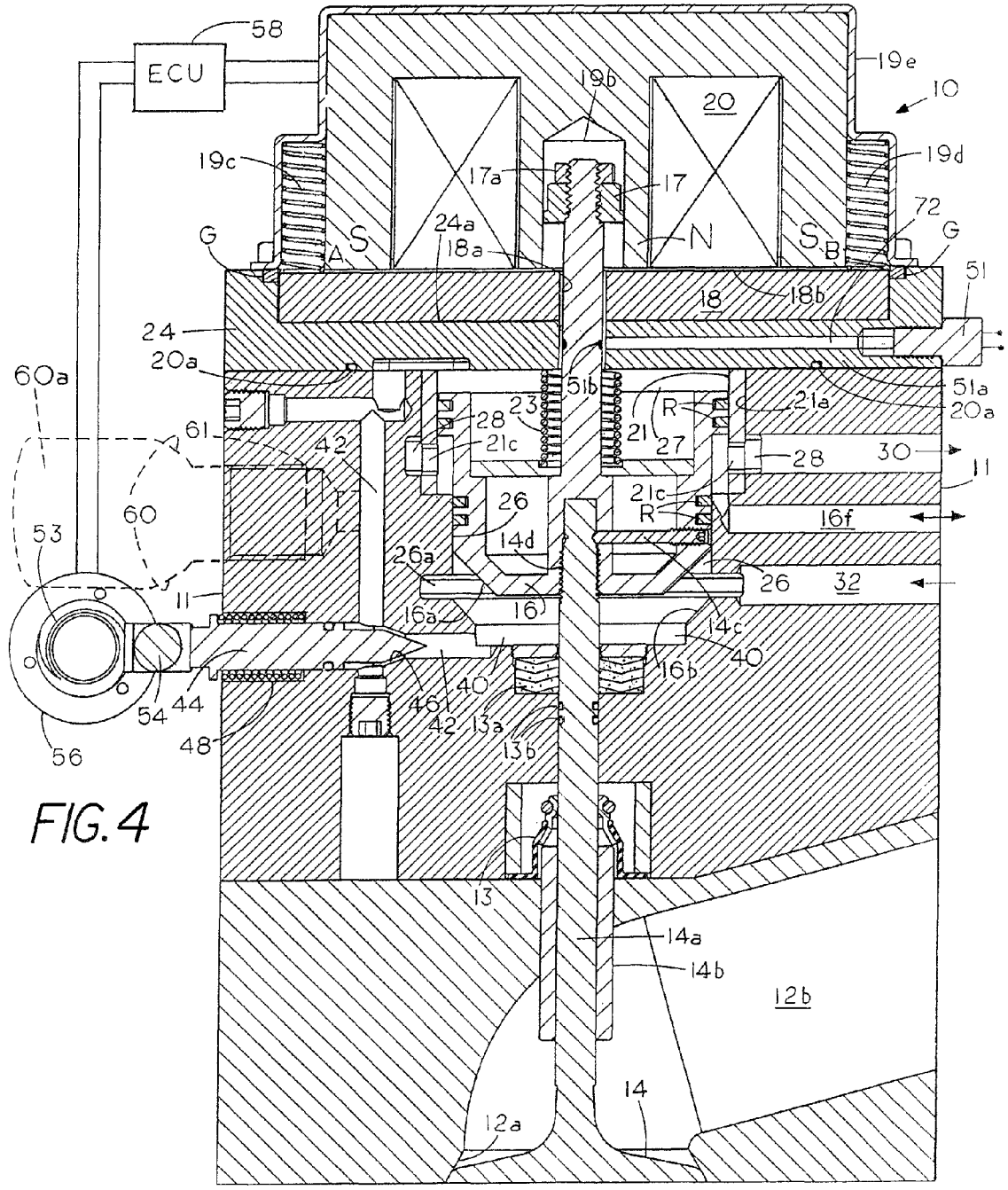
FIG. 4 is a view similar to FIG. 3 with the I.C. valve held closed by the control valve.
Figure 5:
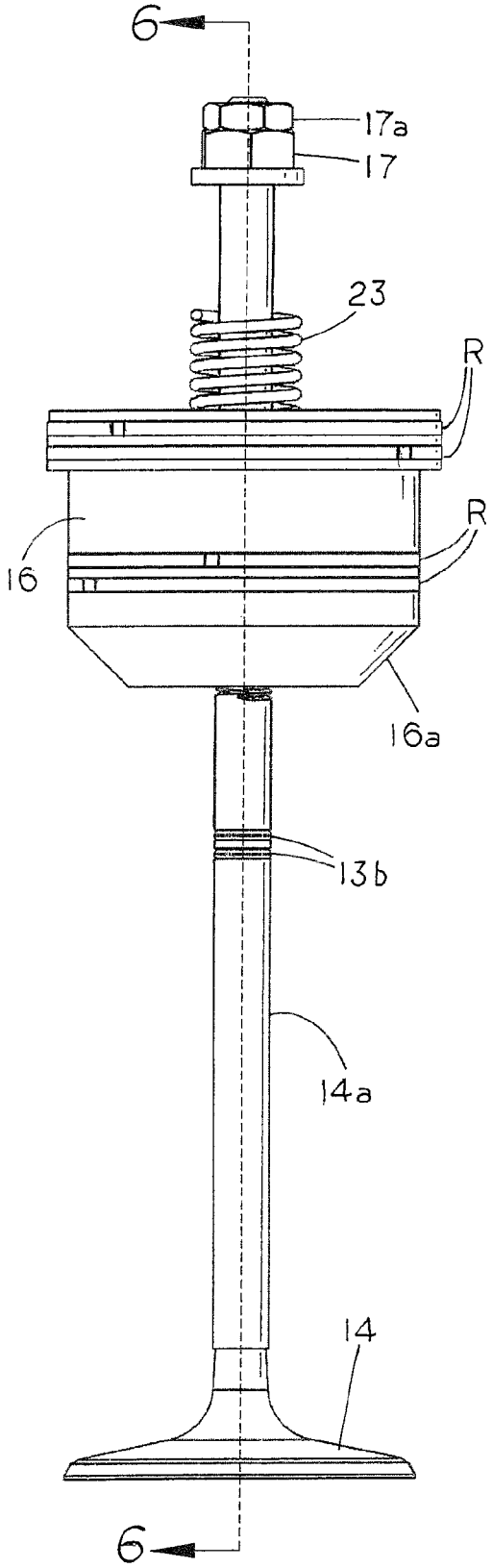
FIG. 5 is a side elevation of the valve train including I.C. valve, valve stem and control valve.
Figure 6:
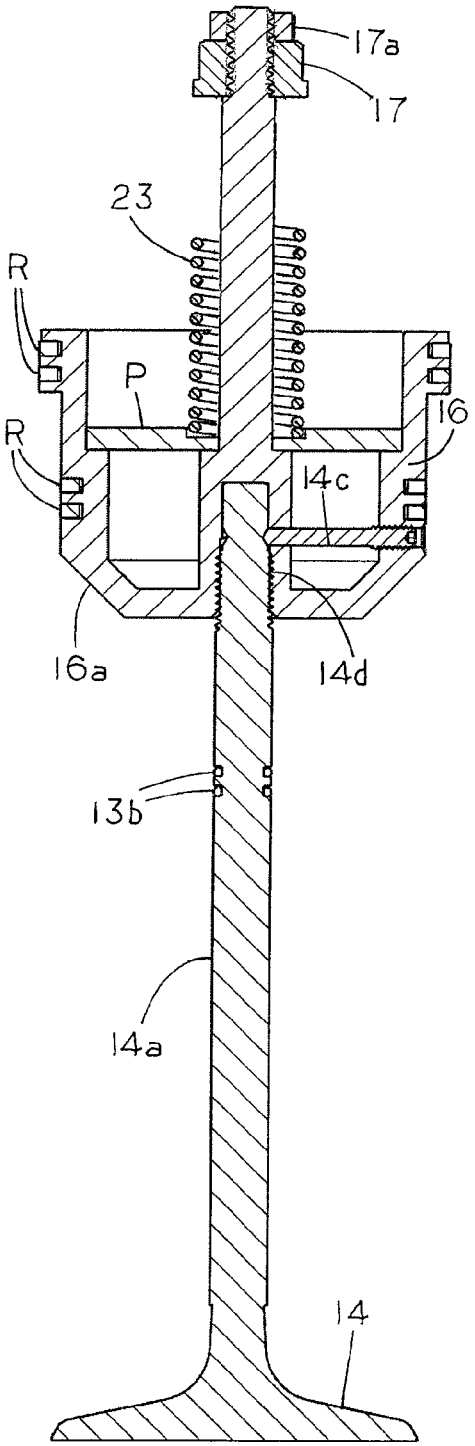
FIG. 6 is a vertical cross-section on line 6-6 of FIG. 5.
Figure 7:
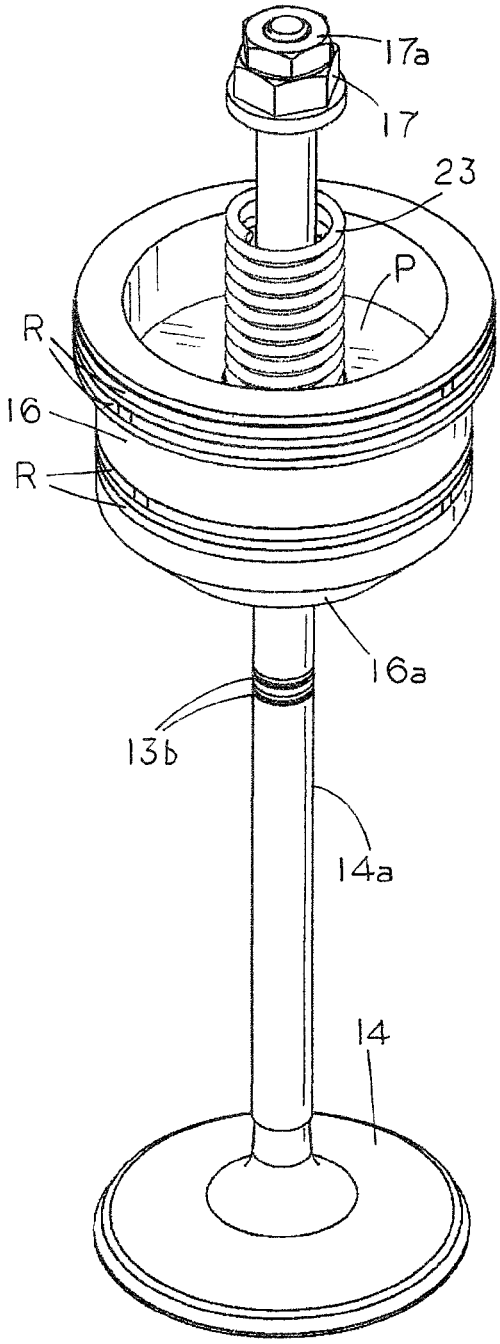
FIG. 7 is a perspective view of the control valve stem and control valve spool.
Figure 8:
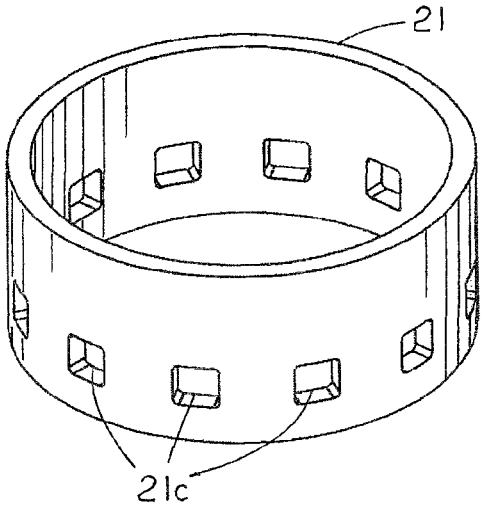
FIG. 8 is a perspective view of the control valve sleeve.

FIG. 1 shows an internal combustion valve and actuator assembly 10 with an actuator casing 11 that is mounted on internal combustion (I.C.) engine 12. FIGS. 3 and 4 show how each I.C. engine valve 14 has a valve stem 14*a* and a securely connected control valve piston or spool 16. Above valve spool 16 is an electromagnet 19 and armature 18. The I.C. valve 14, control valve spool 16 and armature 18 are all operatively connected to a common valve stem 14*a*. An I.C. valve seat 12*a* is shown at the lower end of exhaust or intake passage 12*b*. At its uppermost end the I.C. valve stem 14*a* has an enlarged stop 17 which can comprise a head element or threaded nut and lock nut 17*a*, the lower or inward surface of which acts as an abutment that during operation is forced upwardly by contact with the upper surface of the electromagnet armature 18 as it raises the stem 14*a* and closes the I.C. valve 14. The armature has a planar shape with a central hole 18*a* through which the I.C. engine stem 14*a* passes and is thus mounted loosely on stem 14*a*. The armature is yieldably biased by springs 19*d* and 19*c* into a recess 24*a* within a cover 24 in a position that typically provides an air gap 18*b* which can be about 0.010 to 0.025 inch below a pole face on line A-B at bottom of electromagnet 19.

The electromagnet 19 can be of various shapes such as rectangular or a donut-shape but preferably has a laminated E-shaped iron core as shown with poles as indicated and an electrical conductor winding 20. The electromagnet 19 has a downwardly opening pocket 19*b* to provide space for the stop 17 when the valves 14, 16 and stem 14*a* are elevated. Both the electromagnet 19 and the springs 19*c* and 19*d* can be held inside a housing 19*e* which is bolted onto cover 24 at the top of the actuator casing 11 with a gasket G between them to hermetically seal the electromagnet to the top of the cover 24. This prevents air leakage from the top of the actuator without the need for packing around the top of the stem 14*a*. An O-ring 20*a* seals the cover 24 to the casing 11.

Both the upper and lower sections of the control valve 16 are provided with compression rings R that seal the valve body and the surrounding bore. The lower edges of the bottom set of rings R can be chamfered to facilitate insertion. Alternatively, the casing 11 has a horizontal parting line (not shown) so that the rings can be more easily compressed as they are being inserted. The valve piston or spool 16 is sealingly and slidably mounted at its upper end within a sleeve 21 that is pressed into an upper bore 21*a* in the casing 11. The lower end of valve body 16 is slidably and sealingly mounted in a coaxial lower bore 26 of a smaller diameter in the casing 11. A partition P can be welded in place within the valve piston or spool 16 with a recess for spring 23. The larger ID of the sleeve 21 makes it possible for the same fluid supply pressure at both ends of spool 16 to create a much greater downward force on the valve body so as to overcome the upward force from below thereby opening the I.C. valve. The ratios of the large and small diameter at the ends of the control spool 16 are arranged such that an initial increase in fluid pressure on the larger diameter in control cavity 27 the instant the spool is raised together with the force of the spring 23 as installed does not exceed the fluid force at the opposing lower end of the control valve 16. In one prototype the large bore diameter was 2.25 inches and the lower bore was 2 inches.

Spool 16 is urged downwardly onto a tapered seat 16*b* by the compression spring 23 that can have a compressed force of about 20-30 lbs. The installed (minimum) force which can be in the range of 10-15 lbs. is arranged to exceed the efflux gas pressure on the head of the I.C. valve 14 during the exhaust stroke.

Inside the sleeve 21 within the casing 11 is a timing control cavity 27 above the valve spool 16 which when seated communicates via circumferentially distributed ports 21*c* in sleeve 21 through a counter bore 28 and an outlet duct 30 leading to a sump or sink at atmospheric pressure (not shown).

The lower bore 26 is surrounded by a counter bore 26*a* that communicates with a fluid supply or inlet duct 32 through which fluid either a gas such as air, steam or a hydraulic fluid is pumped at a selected pressure, e.g., 100-400 psi during operation. The air space within sleeve 21 below the top portion of the spool 16 is vented to atmosphere through duct 16*f*. The valve spool 16 has a downwardly and centrally tapered poppet valve surface 16*a* at its lower end which is yieldably biased by spring 23 in sealing engagement with the seat 16*b* while the I.C. valve 14 is fully open as shown in FIG. 3.

Figure 11:
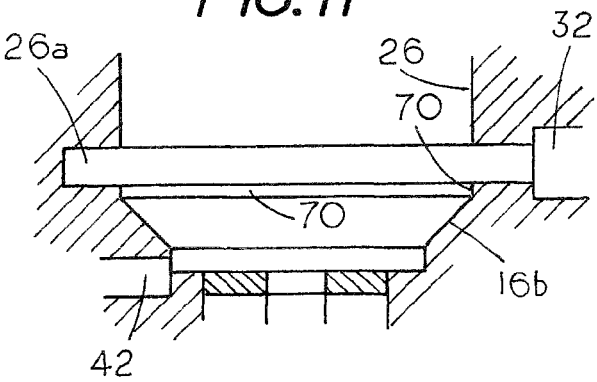
FIG. 11 is a diagram of a modified seat for the control valve spool

In the last 0.030 inch downward movement of the spool 16 when the top ring R passes and then opens the ports 21*c*, momentum and spring 23 carries the spool onto seat 16*b* thereby removing all upward force on the spool. In the embodiment of FIG. 11 there is an annular lip 70 extending upwardly from the upper edge of the seat 16*b* with a close fit to the spool side wall which seals on the side of the spool before the spool contacts seat 16*b* and before the ports 21*c* open.

Just below the tapered poppet valve seat 16*b* is a valve chamber 40 within the casing 11 that communicates when valve spool 16 is off its seat 16*b* between the bore 26, the supply duct 32 and a metering duct 42. In the metering duct 42 is a metering needle valve 44 that is yieldably urged off of its seat 46 by a compression spring 48 to enable the flow rate of fluid from the supply duct 32 and valve chamber 40 to be regulated through duct 42 into the timing control cavity 27 above the valve body 16 for controlling the seating of spool 16 as will be described below.

The valve stem 14*a* is slidably mounted within a standard valve guide 14*b* which extends upwardly into a commercially available rubber valve seal 13. Above the seal 13, the valve stem 14*a* is sealed by means of a fiber reinforced compression packing 13*a* and two O-rings 13*b*. A lower portion of the valve stem 14*a* can be secured to on upper portion by screw threads 14*d* that are secured in place by means of a set screw 14*c*.

Figure 2:
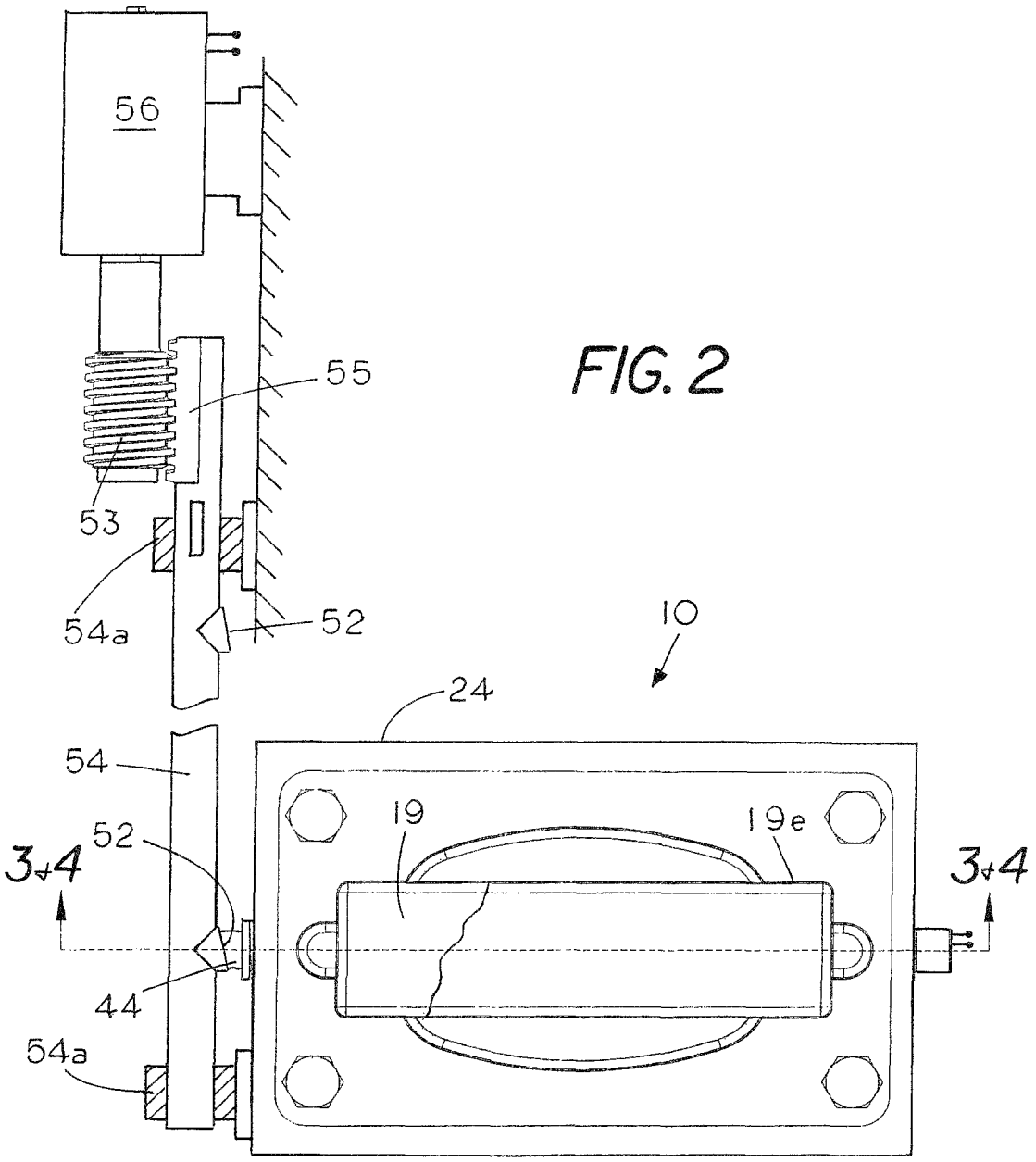
FIG. 2 is a top view on a larger scale.

FIGS. 1-4 show how the position of each of several control valves 44 in a multi-cylinder engine can be set simultaneously by changing the position of several camming ramps 52 (one for each cylinder) affixed to control rod 54 that is slidably mounted in support brackets 54*a* to be moved axially to any selected position by a stepper motor 56 positioned by an electronic control unit (ECU) 58 through a worm gear 53 and rack 55 on the rod 54. The camming ramp 52 for each engine cylinder rests on the outer end of a needle 44. As the rod 54 is moved upwardly as seen in FIG. 2 the metering needles 44 are moved by each ramp 52 closer to their seats 46 thereby reducing the flow rate of fluid past valve 44. Movement of rod 54 in the opposite direction has the reverse effect.

It is preferred that the cross-sectional area of the upper end of the spool 16 is somewhat larger than the area at the lower end of the spool, in this case for example, 2.25 inches diameter at the top and 2 inch diameter at the lower end of the spool 16. With this diameter ratio the force applied to the top of spool 16 due to compression at the moment the valve 16 is first raised to its uppermost will not exceed the force applied by supply pressure to the lower end of the spool 16. The pressure will then be able to rise in the timing chamber 27 responsive to the controlled flow rate through the valve 44 until a much greater down force and spring 23 slams the valve 16 to its seated position of FIG. 3 at the time selected.

To correctly time the I.C. valve 14, the ECU 58 must have the time of its opening and closing. FIGS. 3 and 4 show one example in this case how light from a source at 51 introduced through part of a fiber optic bundle 72 can be reflected or not reflected based on the position of a marker 51*a*. If reflected light returns through a second portion of the fiber optic bundle 72 to a sensor at 51 it indicates the instant valve 14 opens and closes.

Operation with Compressed Air or Steam

The operation of the apparatus for controlling I.C. valve timing when using compressed air or other vapor, gas as a working fluid will now be described. Before starting, the spring 23 holds valve spool 16 closed and I.C. valve open. A current pulse from the ECU 58 at the time selected energizes the electromagnet 19 raising the armature 12, first taking up tappet clearance to bring its upper surface into contact with the lower surface of the stop 17. The armature then rises through the air gap, typically about 0.010 to 0.025 inch until the armature is seated on the pole face A-B of the electromagnet 19 while imparting upward movement to the valve stein and both valve 14 and spool 16. Because the armature is little more than a microscopic distance from the electromagnet 19, it can be seen that the force applied by the electromagnet 19 can approach the maximum that its magnetic force field is capable of achieving, i.e., a force that is not significantly diminished by having been produced in an area of reduced magnetic flux density. This helps maximize both the magnetic traction force and cycling rates.

While the piston 16 is seated, there is no axial thrust applied to it regardless of the pressure of the compressed air supply in duct 32. However, as the valve spool 16 is lifted off its seat 16*b* slightly by the armature 18, compressed air or other fluid is injected past the valve seat 16*b* below the valve spool forcing the spool upwardly closing the I.C. engine valve 14 as well as closing the outlet vent ports 21*c* that lead through duct 30 to the sump. In this way the upward fluid pressure applied to the valve spool 16 from below makes it possible to eliminate the heavy spring commonly used in I.C. engines. As the valve 16 rises off its seat the valve stem 14*a* slides upwardly through the opening 18*a* in the armature and the stop 17 moves up into the pocket 19*b*.

With spool 16 off its seat, air flows past the control needle 44 through duct 42 into the control cavity 27. When the pressure above valve spool 16 exceeds the force of spring 23 and the upward force from below the valve, the spool 16 is propelled onto its seat 16*b* at the time established by the setting of needle 44 thereby opening the I.C. valve at the time selected by ECU 58. The larger ID on the top of the spool in the sleeve 21 makes it possible for the same fluid supply pressure at both ends of spool 16 to create a greater downward force on the valve body so as to greatly exceed the upward force from below thereby driving open the I.C. valve. The closer metering valve 44 is moved to its seat 46, the longer is the time interval required for the pressure in cavity 27 to exceed upward fluid pressure on valve 16. When metering valve 44 is opened more, the time interval is shortened.

Operation with Liquid Hydraulic Fluid

Operation is generally as described above. However, to prevent a relatively static fluid condition in the duet 42 past the control needle 44, a commercial hydraulic accumulator 60 preferably of the gas pressurized type having a sealed chamber 60*a* can be coupled to duct 42 between needle valve 44 and control chamber 27 through a port 61. During operation when magnet 19 raises the armature 18 causing pressurized hydraulic fluid to be injected below valve body, the I.C. valve 14 is almost instantly driven onto its seat 12*a* and the outlet ports 21*c* which lead to the sump at atmospheric pressure are closed. Pressurized hydraulic liquid then flowing past needle 44 in duct 24 charges the accumulator 60 to the supply pressure, at a rate regulated by setting of the control needle 44. When the rising pressure in accumulator 60 and timing control chamber 27 overcomes the hydraulic lifting force on valve body, the spool 16 is forced down against its seat 16*b* moving the I.C. valve 14 to its fully open position at the selected time. If the ECU 58 and the control rod 54 move each valve 44 closer to its seat 46, the timing of the opening of I.C. valve 14 is phased later in the cycle. When each valve 44 is raised further off its seat, each I.C. valve 14 is opened earlier in the cycle.

Figure 9:
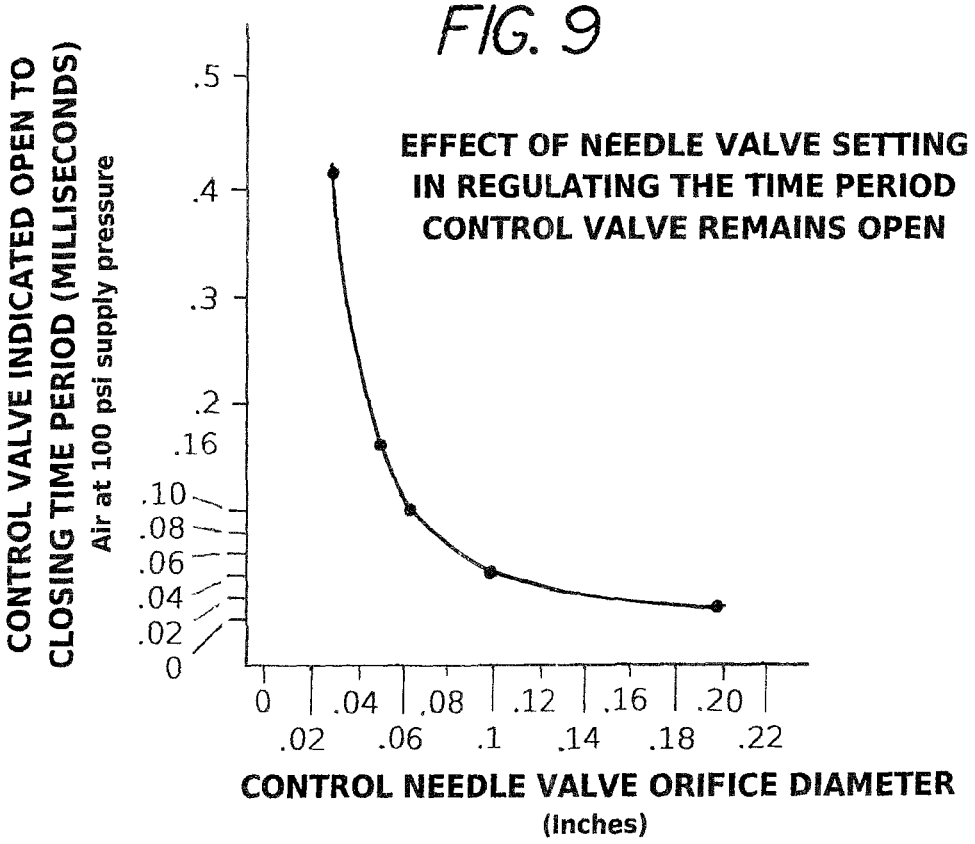
FIG. 9 is a graph showing how the needle valve setting controls the time the I.C. engine valve closed and control valve is open.

Refer now to FIG. 9. As explained above, the time interval for valve 16 to remain open is controlled by a needle valve 44 which regulates the flow of a fluid from a high pressure source, e.g., 100 psi to a control chamber 27 above valve 16. The graph of FIG. 9 shows how the time required for pressurized air in this case to reach 100 psi from 14.7 psig varies with the size of an adjustable metering opening. It will be seen that the opening of valve 44 can accurately control the time for chamber 27 to exceed the force produced by the supply pressure on the lower surface of valve 16 whereby the downward force caused by air pressure on the top of spool 16 and the spring 23 will then drive valve spool 16 closed onto its seat 16*b* opening I.C. valve 14 at a selected time.

Figure 10:
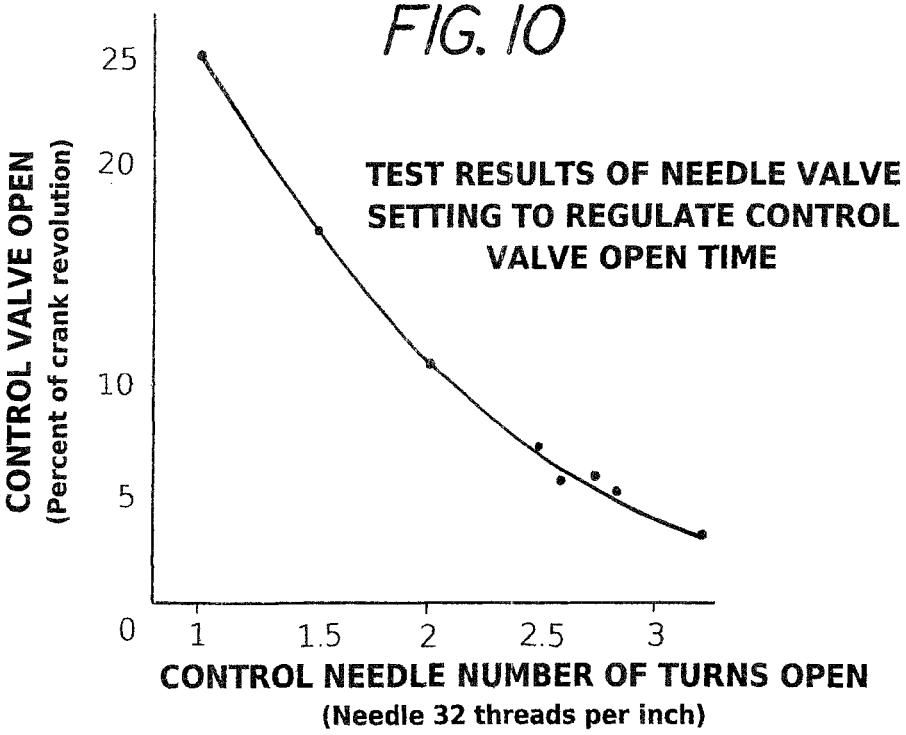
FIG. 10 is a graph showing test results in timing a reciprocating control valve using a needle valve similar to that shown in FIGS. 3 and 4.

FIG. 10 shows the results of several test runs carried out using compressed air at 130 psi with a control valve test article similar to spool 16 but having an OD of 2.5 inches throughout. The size of the timing needle and relative size of the control chamber 27 above the spool were proportioned to have the spool open and close during a fraction of a rotation of the crank. The graph demonstrates how the time in each cycle required for the control valve to be lowered to the closed position was accurately controlled during the test by a needle valve setting.

EXAMPLE

A test article comprising a laminated electromagnetic 19 and armature 18 measuring 2.5×3×1 inch with a stator winding of 40 turns and an armature air gap set at 0.010 inch when supplied with 12.4 amperes DC will develop an indicated traction force on the armature of about 150 lbs. When using a return spring 23 of 30 lbs., the net upward force on the armature therefore is 120 lbs.

When running at 7200 RPM, the duration of each cycle of two revolutions in a four-stroke engine would be 60 cycles per second or 16.7 ms. per cycle. A typical exhaust valve is open about 250/720 of each 16.7 ms. cycle or 5.8 ms. and closed for 10.9 ms.

A cycling test was conducted using a snubber type network circuit of known construction in which the test article having an air gap of 0.010 inch drew 12.4 amps at 60 hertz. Conditions were as follows during the test: Stator winding 0.049 ohms at an inductance of 0.003 heneries, sensing resistor 0.113 ohms at 1.4 volts and current measured at 12.4 amperes. An oscilloscope indicated the time period required to build up flux in the magnet was 3.5 ms.

The remaining time indicated to move the armature and the entire valve train weighing about 0.5 lb. up 0.375 inches by applying a pressure of 100 psi to control valve 16 having an OD at its lower end of 2 inches to a fully closed position is 1.7 ms. resulting in a total control valve opening time of 5.2 ms. (3.5+1.7 ms) out of the complete cycle lasting 16.7 ms. at 7200 RPM. During operation the closing of the I.C. valve can then be detected by the sensor 51 so that the ECU 58 has information to then advance or retard the actuation pulse to the electromagnet 19 such that closing of the I.C. valve occurs at the desired point in the cycle. When cycled at 120 Hz for over an hour, the total electromagnet energy loss was 15 watts which was within acceptable limits.

The terms "up", "down", "raise", "lower" and the like are used relative to other parts of the device not to orientation relative to the earth.

Many variations of the invention within the scope of the foregoing specification will apparent to those skilled in the art once the principles described herein are read and understood.

The invention claimed is:

1. An internal combustion engine valve assembly comprising:

an internal combustion engine gas exchange poppet valve for controlling engine intake or exhaust gases, the poppet valve having a valve stem;

a fluid control valve that includes a piston operatively associated with the valve stem and an electromagnet;

wherein the internal combustion engine valve assembly includes a movable armature spaced from a pole face of the electromagnet by a gap;

wherein the armature initiates movement of both the fluid control valve and the gas exchange poppet valve through a distance equal to the gap;

wherein the movable armature is movably associated with the valve stem for allowing the valve stem to slide relative to the movable armature and wherein the fluid control valve piston is movable within the internal combustion engine valve assembly to impart movement to the valve stem by a force-transmitting engagement between the armature and the stem allowing the fluid control valve piston to drive the valve stem and the gas exchange poppet valve a greater distance than the gap responsive to fluid pressure thereon to move the gas exchange poppet valve to a selected position.

2. The internal combustion engine valve assembly of claim 1, wherein a timer is operatively associated with the fluid control valve to regulate a movement of the valve piston from an open position to a seated position.

3. A fluid-electric actuated internal combustion engine valve assembly comprising, an electromagnet having an armature formed from ferromagnetic material;

a fluid flow control valve having a spool operatively associated on a common valve stem with the armature and an internal combustion engine valve;

wherein the spool of the fluid control valve is slidably and sealingly mounted within a bore in the internal combustion engine valve assembly, the spool is connected to the common valve stem and has a valve sealing surface at one end that when open allows the flow of fluid from a source of pressurized fluid through the bore holding the fluid flow control valve to a timer that regulates movement of the spool, the common valve stem and the internal combustion engine valve;

wherein the common valve stem is configured to actuate the fluid flow control valve via the armature when the electromagnet establishes a magnetic field; and wherein the valve spool of the fluid control valve is moved in the bore by the pressurized fluid applied on said one end to an open position for driving the internal combustion engine valve along an axis extending between an open position and closed position thereof by the movement of the spool of the fluid flow control valve.

4. The fluid-electric actuated internal combustion engine valve assembly of claim 3, wherein each of the spool of the fluid control valve and the internal combustion engine valve has a valve sealing face directed toward one another on the common valve stem; and wherein opening of the spool of the fluid flow control valve closes the internal combustion engine valve.

5. The fluid-electric actuated internal combustion engine valve assembly of claim 3, wherein the common valve stem is operatively associated with the armature by a stop having an abutment surface coupled to the common valve stem that is positioned to be moved by the armature when the electromagnet is energized to move the common valve stem and in turn move the internal combustion engine valve toward a closed position as the spool of the fluid flow control valve moves off of a valve seat that is located within the internal combustion engine valve assembly confronting the spool of the fluid flow control valve.

6. The fluid-electric actuated internal combustion engine valve assembly of claim 3, wherein the timer comprises a metering valve within a channel communicating between two chambers located on opposite ends of the spool of the fluid control valve to transfer the pressurized fluid flowing from one chamber of said two chambers to the other of said two chambers at a selected rate after the fluid flow control valve is opened to time movement of the common valve stem and movement both of said fluid flow control valve and said internal combustion engine valve.

7. The fluid-electric actuated internal combustion engine valve assembly of claim 6 further including a hydraulic accumulator;

wherein the fluid is a liquid; and wherein the hydraulic accumulator is connected to a passage between the metering valve and the fluid control valve for receiving liquid flowing through the passage.

8. The fluid-electric actuated internal combustion engine valve assembly of claim 7, wherein the accumulator includes a sealed chamber containing a pressurized gas.

9. The fluid-electric actuated internal combustion engine valve assembly of claim 6, wherein the metering valve has an opening that is enlarged or reduced to a selected size by an electronic engine control unit to vary a flow rate of the fluid flowing between the chambers.

10. The fluid-electric actuated internal combustion engine valve assembly of claim 3, wherein the spool of the fluid flow control valve has cylindrical portions at opposite ends of different diameters.

11. The fluid-electric actuated internal combustion engine valve assembly of claim 10, wherein the cylindrical portions are each sealed in separate coaxial bores within said engine valve assembly.

12. A fluid-electric actuated internal combustion engine valve assembly comprising:

an electromagnet having a fixed stator and a movable armature that is attracted by a magnetic field generated by the electromagnet;

a control valve piston sealingly and slidably mounted within a casing;

an internal combustion poppet valve; and a stop element having an abutment surface coupled to a common valve stem;

wherein the internal combustion poppet valve, the movable armature, the stop element and the control valve piston are operatively associated on the common valve stem within the internal combustion engine valve assembly;

wherein the control valve piston is connected to the common valve stem and has a valve seal proximate a first end for controlling the flow of fluid from a source of pressurized fluid through a metering valve to a timing control chamber at a second end of the control valve piston; and wherein the abutment surface of the stop element is constructed and arranged to be moved by controlling electric current supplied to the electromagnet to enable the movable armature to engage the abutment surface of the stop element for opening the valve seal proximate the end of the control valve piston such the pressurized fluid then exerts an axial fluid force on the control valve piston for continuing a motion enabled by the electromagnet and movable armature driving the internal combustion poppet valve to a closed position by the pressurized fluid.

13. The fluid-electric actuated internal combustion engine valve assembly of claim 12, wherein the engine is a multi-cylinder engine;

wherein each engine cylinder of the multi-cylinder engine includes the internal combustion engine valve assembly;

wherein each of the internal combustion engine valve assembly has a metering valve for controlling a rate of flow of a fluid between chambers located within the internal combustion engine valve assembly at opposite ends of the control valve piston and a movable metering control member is operatively associated with the metering valve for controlling a degree of a metering opening of the metering valve.

14. The fluid-electric actuated internal combustion engine valve assembly of claim 12, wherein the internal combustion engine valve is an inlet valve or an exhaust valve having a predetermined lift;

the armature is of planar construction having a pair of opposite sides and an opening extending from one side to another side of the pair of the opposite sides;

the common valve stem extends slidably through the opening;

the stop element abutment surface is located on a same side of the movable armature as the electromagnet;

the armature is yieldably held in spaced relationship to a pole face of the electromagnet by an air gap that is a fraction of a lift distance of the internal combustion valve being less than 20% thereof and wherein the movable armature is subjected to a magnetic traction force responsive to a magnetic flux density existing proximate the pole face of the electromagnet.

15. An actuator assembly of a reciprocating piston engine having engine valves comprising an inlet valve and an exhaust valve for controlling at least one of an inlet flow to and an exhaust flow out of the reciprocating piston engine comprising:

an actuator casing;

a cylindrical valve body slidably and sealingly mounted within a cylindrical bore in the casing that has first and second chambers therein at first and second ends of the valve body;

wherein the cylindrical bore has a supply port therein for admitting pressurized fluid into the cylindrical bore, the valve body sealing the port from the first chamber when moved axially to a closed position proximate the first chamber;

an electromagnet for moving the cylindrical valve body axially within the cylindrical bore for enabling the fluid to enter the first chamber via the supply port;

an armature mounted within the actuator assembly in a position spaced by a gap from the electromagnet;

a traction rod extending from the cylindrical valve body that is connected to one of the engine valves, the traction rod being slidably related to the armature;

a stop having an abutment surface coupled to the traction rod in a position to be moved by the armature toward the electromagnet when the armature moves toward the electromagnet to open said valve body for allowing fluid to flow from said first chamber to said second chamber through a duct communicating between the first chamber and the second chamber and a metering valve in the duct to regulate the flow of fluid therethrough from said first chamber to said second chamber.

16. The actuator assembly of claim 15, wherein the cylindrical valve body has a section of a first diameter at one end and a section of a second diameter at an opposite end and the section of the first diameter and the section of the second diameter are each sealingly and slidably mounted within one of a pair of coaxial portions of the cylindrical bore that have different diameters.

17. The actuator assembly of claim 16, wherein the section of the first diameter is smaller than the section of the second diameter and wherein a movement of the cylindrical valve body to an open position allows flow of the fluid from the supply port through the first chamber and the duct to the second chamber which applies a fluid pressure force to the cylindrical valve body in the second chamber that imparts a closing movement atoll of the cylindrical valve body toward a position proximate the first chamber.

18. An actuator assembly of a reciprocating piston engine having engine valves comprising an inlet valve and an exhaust valve, the actuator assembly comprising:

an actuator casing;

a cylindrical valve body for operating at least one of the engine valves;

wherein the cylindrical valve body is connected to the at least one of the engine valves and is slidably and sealingly mounted within a cylindrical bore in the casing that has first and second chambers therein at first and second ends of the valve body;

wherein a cylindrical bore has a supply port for admitting pressurized fluid into the cylindrical bore, the cylindrical valve body sealing the supply port from the first chamber when moved axially to a closed position proximate the first chamber;

a metering orifice in a duct between said first and second chambers to regulate the flow of fluid therethrough from said first chamber to said second chamber;

wherein the cylindrical valve body has a section of a first diameter at one end and a section of a second diameter that is different from the first diameter at an opposite end and each of the first diameter section and the second diameter section is sealingly and slidably mounted within one of a pair of coaxial portions of the cylindrical bore that have different diameters; and a valve lifter operatively associated with the cylindrical valve body to shift the cylindrical valve body away from the first chamber to enable the fluid to flow from the supply port to the first chamber and through the orifice in the duct to the second chamber thereby pressurizing the second chamber to produce a force that exceeds an opposing force applied to the valve body by fluid pressure within the first chamber thereby moving the valve body and at least one engine valve to a selected position by the fluid pressure applied to the cylindrical valve body.

* * * * *